US007028746B2

(12) United States Patent
Akers et al.

(10) Patent No.: US 7,028,746 B2
(45) Date of Patent: Apr. 18, 2006

(54) APPARATUS FOR MOLDING METALS

(75) Inventors: Ron Akers, Guntersville, AL (US); Ralph E. Vining, Brooklyn, MI (US); D. Matthew Walukas, Ypsilanti, MI (US); Raymond F. Decker, Ann Arbor, MI (US); Chris Pedder, Troy, MI (US)

(73) Assignee: Thixomat, Inc., Ann Arbor, MI (US)

( * ) Notice: Subject to any disclaimer, the term of this patent is extended or adjusted under 35 U.S.C. 154(b) by 41 days.

(21) Appl. No.: 10/685,951

(22) Filed: Oct. 14, 2003

(65) Prior Publication Data

US 2004/0084171 A1 May 6, 2004

Related U.S. Application Data

(62) Division of application No. 09/861,250, filed on May 18, 2001, now abandoned.

(51) Int. Cl.
*B22D 17/00* (2006.01)

(52) U.S. Cl. ..... 164/113; 164/900; 164/312

(58) Field of Classification Search ..... 164/113, 164/312, 900
See application file for complete search history.

(56) References Cited

U.S. PATENT DOCUMENTS

| | | | | | |
|---|---|---|---|---|---|
| 4,694,881 | A | | 9/1987 | Busk | 164/113 |
| 4,694,882 | A | | 9/1987 | Busk | 164/113 |
| 5,040,589 | A | * | 8/1991 | Bradley et al. | 164/113 |
| 5,375,645 | A | * | 12/1994 | Brueker et al. | 164/457 |
| 5,680,894 | A | * | 10/1997 | Kilbert | 164/312 |
| 5,711,366 | A | | 1/1998 | Mihelich et al. | 164/312 |
| 5,983,978 | A | * | 11/1999 | Vining et al. | 164/312 |
| 6,059,012 | A | | 5/2000 | Vining et al. | 164/312 |
| 6,151,198 | A | | 11/2000 | Prater et al. | 360/265.7 |

FOREIGN PATENT DOCUMENTS

WO WO 97 21509 6/1997

* cited by examiner

*Primary Examiner*—Kevin P. Kerns
(74) *Attorney, Agent, or Firm*—Brinks Hofer Gilson & Lione

(57) ABSTRACT

An apparatus for molding a metal material. The apparatus includes a vessel with portions defining a passageway through the vessel. An inlet is located toward one end and a member or agitation means is located within the passageway. A plurality of heaters are located a length of the vessel. The first of the heaters is located immediately downstream of the inlet and is a low frequency induction coil heater whereby the temperature gradient through the vessel's sidewall is minimized.

20 Claims, 7 Drawing Sheets

°F

| TIME MINUTES | ZONE 1 | | | ZONE 2 | | | |
|---|---|---|---|---|---|---|---|
| | 1 | 2 | 3 | 4 | 5 | 6 | 7 |
| | 634 | 968 | 1100 | 1004 | 1020 | 1093 | 1100 |
| 45 | 641 | 973 | 1101 | 1032 | 1041 | 1113 | 1100 |
| 50 | 658 | 976 | 1100 | 1054 | 1043 | 1122 | 1100 |
| 55 | 670 | 980 | 1101 | 1071 | 1091 | 1123 | 1099 |
| 60 | 678 | 982 | 1100 | 1078 | 1088 | 1122 | 1100 |
| 65 | 693 | 981 | 1101 | 1098 | 1107 | 1132 | 1101 |
| 70 | 705 | 1001 | 1101 | 1093 | 1084 | 1133 | 1099 |
| 75 | 709 | 989 | 1100 | 1097 | 1126 | 1125 | 1103 |
| 80 | 712 | 993 | 1100 | 1100 | 1101 | 1133 | 1103 |
| 85 | 721 | 996 | 1100 | 1094 | 1110 | 1128 | 1102 |
| 90 | 728 | 994 | 1100 | 1099 | 1104 | 1130 | 1099 |
| 95 | 735 | 994 | 1100 | 1105 | 1114 | 1137 | 1101 |
| 100 | 747 | 1000 | 1100 | 1106 | 1117 | 1137 | 1099 |
| 105 | 750 | 1006 | 1100 | 1105 | 1112 | 1133 | 1103 |
| 110 | 746 | 1005 | 1100 | 1109 | 1114 | 1136 | 1101 |
| 115 | 750 | 1003 | 1100 | 1105 | 1116 | 1135 | 1100 |
| 120 | 763 | 1001 | 1100 | 1101 | 1121 | 1136 | 1099 |
| TARGET | | | 1100 | 1100 | 1100 | 1100 | 1100 |

BENEFIT OF LOW FREQUENCY INDUCTION HEATING ON BARREL SHELL AND LINER STRESS DURING PREHEATING (20 MINUTES) (FOR 0.5 IN. SHRUNK FIT STELLITE LINER IN A 1.85 IN. ALLOY 718 SHELL)

| | | | STRESS, KSI | | | |
|---|---|---|---|---|---|---|
| HEATING METHOD | ΔT °F | COMPONENT | LONG | RADIAL | HOOP | VON MISES |
| CERAMIC BAND | 403[1] | LINER | 107 | 43 | 102 | 111[2] |
| | | SHELL | 38 | 43 | 26 | |
| LOW FREQUENCY INDUCTION | 0[3] | LINER | -16 | -2 | -13 | 15[4] |
| | | SHELL | 4 | -2 | 7 | |

1. BARREL STILL ONLY AT 700°F, 850 TON BARREL REQUIRES THREE HOURS TO PREHEAT WITHOUT HIGH STRESSES.
2. LINER YIELDS ON HEATING AT 600°F.
3. BARREL AT 1200°F, READY TO RUN.
4. LINER DOES NOT YIELD.

Fig. 7

BENEFIT OF LOW FREQUENCY INDUCTION HEATING AZ91D ON A SIZE

| | DIMENSION OF g PARTICLES (AVERAGE OF 240 PARTICLES) | | | | |
|---|---|---|---|---|---|
| HEATING METHOD | AREA, $\mu^2$ | PERIMETER, $\mu^2$ | ROUNDNESS, $\mu^2$ | WIDTH, $\mu^2$ | HEIGHT, $\mu^2$ |
| CERAMIC BAND | 1202 | 331 | 60.8 | 40 | 42 |
| LOW FREQUENCY INDUCTION | 758 | 241 | 63 | 35 | 34 |

Fig. 8

APPARATUS FOR MOLDING METALS

FIELD OF THE INVENTION

This application is a divisional application of prior U.S. application Ser. No. 09/861,250, filed May 18, 2001 (now abandoned) and claims domestic priority thereto under 35 U.S.C. §§ 120, 121.

The present invention generally relates to metal molding and casting machines. More specifically, the invention relates to a metal molding machine adapted for quicker heat up times, faster cycle times and reduced thermal stresses in the machine.

BACKGROUND OF THE INVENTION

This invention relates to an apparatus for molding metals into articles of manufacture. More specifically, the present invention relates to an apparatus of the above type configured to increase thermal efficiency and increase through-put while decreasing thermal gradients and the resultant stresses.

Metal compositions having dendritic structures at ambient temperatures conventionally have been melted and then subjected to high pressure die casting procedures. These conventional die casting procedures are limited in that they suffer from porosity, melt loss, contamination, excessive scrap, high energy consumption, lengthy duty cycles, limited die life, and restricted die configurations. Furthermore, conventional processing promotes formation of a variety of microstructural defects, such as porosity, that require subsequent, secondary processing of the articles and also result in use of conservative engineering designs with respect to mechanical properties.

Processes are known for forming these metal compositions such that their microstructures, when in the semi-solid state, consist of rounded or spherical, degenerate dendritic particles surrounded by a continuous liquid phase. This is opposed to the classical equilibrium microstructure of dendrites surrounded by a continuous liquid phase. These new structures exhibit non-Newtonian viscosity, an inverse relationship between viscosity and rate of shear, and the materials themselves are known as thixotropic materials While there are various specific techniques for forming thixotropic materials, one technique, an injection molding technique, delivers the alloy in an "as cast" state. With this technique, the feed material is fed into a reciprocating screw injection unit where it is externally heated and mechanically sheared by the action of a rotating screw. As the material is processed by the screw, it is moved forward within the barrel. The combination of partial melting and simultaneous shearing produces a slurry of the alloy containing discrete degenerate dendritic spherical particles, or in other words, a semisolid state of material and exhibiting thixotropic properties. The thixotropic slurry is delivered by the screw to an accumulation zone in the barrel which is located between the extruder nozzle and the screw tip. As the slurry is delivered into this accumulation zone, the screw is simultaneously withdrawn in a direction away from the unit's nozzle to control the amount of slurry corresponding to a shot and to limit the pressure build-up between the nozzle and the screw tip. The slurry is prevented from leaking or drooling from the nozzle tip by controlled solidification of a solid metal plug in the nozzle or by other sealing mechanisms. Once the appropriate amount of slurry for the production of the article has been accumulated in the accumulation zone, the screw is rapidly driven forward (developing sufficient pressure to force the solid metal plug, if necessary, out of the nozzle and into a receiver) thereby allowing the slurry to be injecting into the die cavity so as to form the desired solid article. Sealing the nozzle provides protection to the slurry from oxidation or the formation of oxide on the interior wall of the nozzle that would otherwise be carried into the finished, molded part. This sealing further seals the die cavity on the injection side facilitating the use of vacuum to evacuate the die cavity and further enhance the complexity and quality of parts so molded.

In the above technique, generally all of the heating of the material occurs in the barrel of the machine. Material enters at one section of the barrel while at a "cold" temperature and is then advanced through a series of heating zones where the temperature of the material is rapidly and, at least initially, progressively raised. The heating elements themselves are typically resistance or ceramic band heaters. As a result, a thermal gradient exists both through the thickness of the barrel as well as along the length of the barrel. As further discussed below, the thermal gradient through the barrel thickness is undesirable.

Typical barrel constructions of a molding machine for thixotropic materials have seen the barrels formed as long (up to 110 inches) and thick (outside diameters of up to 11 inches with 3 to 4 inch thick walls) monolithic cylinders. As the size and through-put capacities of these machines have increased, the length and thicknesses of the barrels have correspondingly increased. This has led to increased thermal gradients throughout the barrels and previously unforeseen and unanticipated consequences. Additionally, the primary material, wrought alloy 718 (having a limiting composition of: nickel (plus cobalt), 50.00–55.00%; chromium, 17.00–21.00%; iron, bal.; columbium (plus tantalum) 4.75–5.50%; molybdenum, 2.80–3.30 %; titanium, 0.65–1.15%; aluminum, 0.20–0.80; cobalt, 1.00 max.; carbon, 0.08 max.; manganese, 0.35 max.; silicon, 0.35 max.; phosphorus, 0.015 max.; sulfur, 0.015 max.; boron, 0.006 max.; copper, 0.30 max.) used in constructing these barrels has previously been in short supply.

Since the nickel content of the alloy 718 is subject to be corroded by molten magnesium, currently the most commonly used thixotropic material, more recent barrel designs included a sleeve or liner of a magnesium resistant material to prevent the magnesium from attacking the alloy 718. Several such materials are Stellite 12 (nominally 30 Cr, 8.3W and 1.4C; Stoody-Doloro-Stellite Corp), PM 0.80 alloy (nominally 0.8C, 27.81 Cr, 4.11W and bal. Co. with 0.66N) and Nb-based alloys (such as Nb-30Ti-20W). Obviously, the coefficients of expansion of the barrel and the liner must be compatible to one another for proper working of the machine.

Reviews of failed barrels has yielded information that barrels fail often as a result of the thermal stress and more particularly thermal shock in the cold section or end of the barrels. As used herein, the cold section or end of a barrel is that section or end where the material first enters into the barrel. It is in this section that the most intense thermal gradients are seen, particularly in the intermediate temperature region of the cold section, which is located downstream of the feed throat.

During use of a thixotropic material molding machine as described above, the solid material feedstock, which has been seen in pellet and chip forms, is fed into the barrel while at ambient temperatures, approximately 75° F. Being long and thick, the barrels of these machines are, by their very nature, thermally inefficient for heating a material introduced therein. With the influx of "cold" feedstock, the adjacent region of the barrel is significantly cooled on its interior surface. The exterior surface of this region, however, is not substantially affected or cooled by the feedstock because the positioning of the heaters is directly thereabout. A significant thermal gradient, measured across the barrel's thickness, is resultingly induced in this region of the barrel. Likewise, a greater thermal gradient is also induced along the barrel's length. In this intermediate temperatures region of the barrel where the highest thermal gradients has been found to develop, the barrel is heated more intensely as the heaters cycle "off" less frequently.

Preheating of the barrel prior to production operation has also been long, up to three (3) hours. For example, a barrel having a 0.5 inch thick shrunk fit Stellite liner in a 1.85 inch thick alloy 718 shell, after normal preheating with ceramic band heaters for twenty minutes, the barrel will obtain an external temperature of about 700° F. (1200° F. is required for operation and molding of AZ91D magnesium alloy). At that same point in time, the thermal gradient through the barrel thickness is about 400° F. The barrel cannot be heated more intensely, and therefore faster, because of the generating of greater thermal gradients and stresses which can crack the barrel. Full preheating therefore requires about three (3) hours.

Prior metal processing machines have employed resistance type heaters. This heating technique generates the thermal energy within the resistance heater itself, which then must be transferred from the resistance heater to the barrel and other components of the machine. This means that the energy flow from the resistance heater to the part is maximized by a suitably large temperature differential. To accelerate this thermal transfer, one must obtain higher temperature differentials to overcome the thermal interface between the resistance heater (contact integrity) and the barrel, outer diameter through the barrel radial thickness, then into the feedstock and finally into the screw. Therefore, the energy level that is generated at the outside surface of the barrel, has to be high enough to sufficiently accelerate the energy flow to get uniform heating of the barrel, which therefore slows down the process and causes thermal fatigue of the barrel. Additionally, these resistance heaters, because of the thermal cycling they undergo, are also highly subject to thermal fatigue and frequent replacement. Another major problem is that the resistance heaters cannot couple thermal energy directly in the screw. As a result there are substantial thermal criteria in this arrangement which impact productivity and response to the thermal dynamics of handling incoming cold feedstock.

Within the barrel, a screw rotates, shearing the feedstock and moving it longitudinally through the various heating zones of the barrel. This causes the feedstock's temperature to rise and equilibriate at the desired level when it reaches the hot or shot end of the barrel. At the hot end of the barrel, the processed material exhibits temperatures generally in the range of 1050°–1100° F. The maximum temperature to which the barrel is subjected is near 1300° F. (for magnesium processing). As the feedstock is heated and moved through the barrel, the material is converted into a semisolid state where it develops its thixotropic properties.

Once a sufficient amount of material is accumulated in the hot section of the barrel and the material exhibits its thixotropic properties, the material is injected into a die cavity having a shape conforming to the shape of the desired article of manufacture. Additional feedstock is then introduced into the cold section of the barrel, lowering the temperature of the interior barrel surface, upon the ejection of the material from the barrel.

As the above discussion demonstrates, the interior surface of the barrel, particularly in the intermediate temperature region of the barrel, experiences a cycling of its temperature during operation of the injection metal molding machine. This thermal gradient between the interior and exterior surfaces of the barrel is dependent on barrel design, but has been seen to be as great as 227° F. during production operation.

Because of the significant cycling of the thermal gradient in the barrel, the barrel experiences thermal fatigue and shock. This has been found to cause cracking in the barrel and in the barrel liner in as little time as 30 hours. Once the barrel liner has become cracked, magnesium can penetrate the liner and attack the barrel. Both the cracking of the barrel and the attacking of the barrel by magnesium will contribute to the premature failure of the barrels. Molding machines can also operate in the all liquid state to inject good quality parts; but with the same needs for faster cycles and lower thermal stresses on the barrel as described above. As a variation, such machines can use a plunger rather than a screw for the injection stroke.

From the above it is evident that there exists a need for an improved construction, particularly one which decreases preheating times, decreases operation cycle times and decrease thermal gradients through the barrel thickness.

It is therefore a principle object of the present invention to fulfill that need by providing for an improved construction that optimizes heat transfer to and through-put of material being processed.

Another object of the present invention is to provide a construction decreasing preheating time A further object of the present invention is to provide a construction that reduces thermal fatigue and shock in the barrel by reducing the thermal gradient through.

SUMMARY OF THE INVENTION

The above and other objects are accomplished in the present invention by providing a novel construction where suitable frequency induction heaters are strategically positioned along at least a portion of the length of the barrel. As a result the machine experiences a decrease in the thermal gradient through the thickness of the barrel and a decrease in the cycle time for each successive shot. The coils of the suitable frequency induction heaters generate the optimum power density electromagnetic flux field to induce an electric current that flows within the barrel, liner, processed material and screw. This induced electric current directly heats the barrel, liner, processed material and screw by $I^2R$ (joule) heat generation. By specifying the location, power density and frequency of these induction heaters, it has become possible to decrease the temperature gradient through the various sections of the barrel and while also directly heating the screw and the feedstock. As a result, the temperature gradient through the barrel thickness can be a low as 0° F. after preheating, before the introduction of feedstock or during the holding time between successive shots. Contrarily, resistance heaters can heat only the outer of the barrel surface and then must conduct the heat to the material being processed. The power transferred is simply determined by the wall thickness and surface temperature. With induction, the heat is generated internally to the barrel and screw and the thermal stresses substantially reduced accordingly.

Induction electromagnetic heating generates an alternating flux field which induces an electric current to flow within the operational components of the machine (barrel, screw, and even feedstock). This current generates internal heat within these components based on the induced levels of current (power density) and the inherent electrical resistivity of the particular component. The thermal profile can be adjusted based on power density and frequency and can be programmed to provide the optimum thermal gradient to enhance productivity and process quality.

According to the present invention, the induction coils or heaters are appropriately spaced along the length of the barrel to create the desired temperature gradient along the length of the barrel for optimum melting. The present machine was designed to have a higher power density near the cold end of the machine (the feedstock inlet of the machine) to directly heat and bring the material up to temperature as rapidly as possible. In other words, the material can be heated without requiring conductive heat transfer from the heater itself and through another body or material. The heat input is then profiled along the barrel length to provide the proper power distribution to continue to add energy to the material as it is fed and moved through the barrel. In this manner it is possible to prevent liquid metal from returning to the feed throat through which the feedstock is introduced into the barrel. By limiting liquid metal at the feed throat, the present invention prevents the freezing of such liquid metal, and therefore plugging of the feed throat upon the introduction of feedstock into the barrel. Furthermore, the screw and feedstock itself can be preferentially heated to melt any solid metal plugs, should they form.

The present invention requires the use of suitable low frequency induction heaters. As used herein and based on existing component geometries (barrel, screw, feedstock), the term low frequency induction heaters denotes induction heaters operating at less than 1000 Hz. One preferred frequency range is therefore less than 1000 Hz and another preferred range is greater than 0 and up to 400 Hz. In one construction, the preferred frequency was about 60 Hz. The precise frequency will be dependant upon the specific component criteria and material properties of the machine within which it is employed.

By way of a comparative example, a 245 ton injection metal molding machine, manufactured by Japan Steel Works, with conventional ceramic band heaters on a barrel having a 0.5 inch shrunk fit Stellite liner in a 1.85 inch alloy 718 shell, in processing magnesium alloy AZ91D required 32 to 47 seconds to mold a standard 4 bar tensile molding weighing 326 grams.

A machine according to the principles of the present invention, provided with suitable induction heating coils in zones 1 and 2 of the barrel length, enabled the production of the 4 bar tensile molding on a 16 to 20 second cycle time (a 56% decrease). This production cycle was maintained for several hours without incident. The machine ran quieter and screw retraction was smoother and quicker requiring only 5 seconds (versus 11 seconds for the 245 ton JSW machine having ceramic heaters). In addition, and as seen in the attached tables, the microstructure of the 4 bar tensile molding was refined by this invention, making for more thixotrophy and fluidity and therefore better mold filling. The $\alpha$-solid phase was refined by the vigorous and fast action afforded by the influence of the low frequency heating and the resultant hot screw. As seen in the table, there is a reduction in the area, perimeter, width and height of the $\alpha$-solid phase. The decrease in size and increase in roundness improved the fluidity mentioned above since fluidity is inversely proportional to the diameter times the surface area of $\alpha$.

As utilized above, induction heaters were placed along the initial length of the barrel. Two power sources were utilized for the inductors and both were 60 Hz160 KVA.

With utilization of the present invention, one preferred construction of the barrel (and liner) employs non-magnetic materials. The utilization of non-magnetic materials allows for deeper penetration by the inductive heater. It has additionally been found that the position of the screw is critical during the preheating stage. Preferably the screw is retracted during heat up, prior to feeding of the feedstock for operation, to prevent overheating of the first feedstock at the feed throat. The screw can be moved forward to enable melting of any plugs that may occur during operation. This concept substantially reduces, and possibly eliminates, thermal fatigue problems of both the barrel and the other operational components. The inductor coil design and electromagnetic coupling techniques, as well as axial position, can program the desired thermal profiles to optimize the process quality as well as the productivity objectives. The present invention can therefore provide more accurate process control and faster response time since the thermal energy is generated directly within the mechanical hardware itself.

Additional benefits, advantages and objects of the present invention will become more readily apparent to those skilled in the technology from a reading of the following description and claims and from a review of the drawings appended hereto.

BRIEF DESCRIPTION OF THE DRAWINGS

FIG. 7 is a chart which shows a comparison of the benefits of low frequency inductive heating over ceramic band heaters with barrel and liner stresses during preheating.

FIG. 8 is a chart which shows a comparison of the benefits of low frequency inductive heating on $\alpha$ particle size.

DETAILED DESCRIPTION OF THE PREFERRED EMBODIMENT

Figure 1:
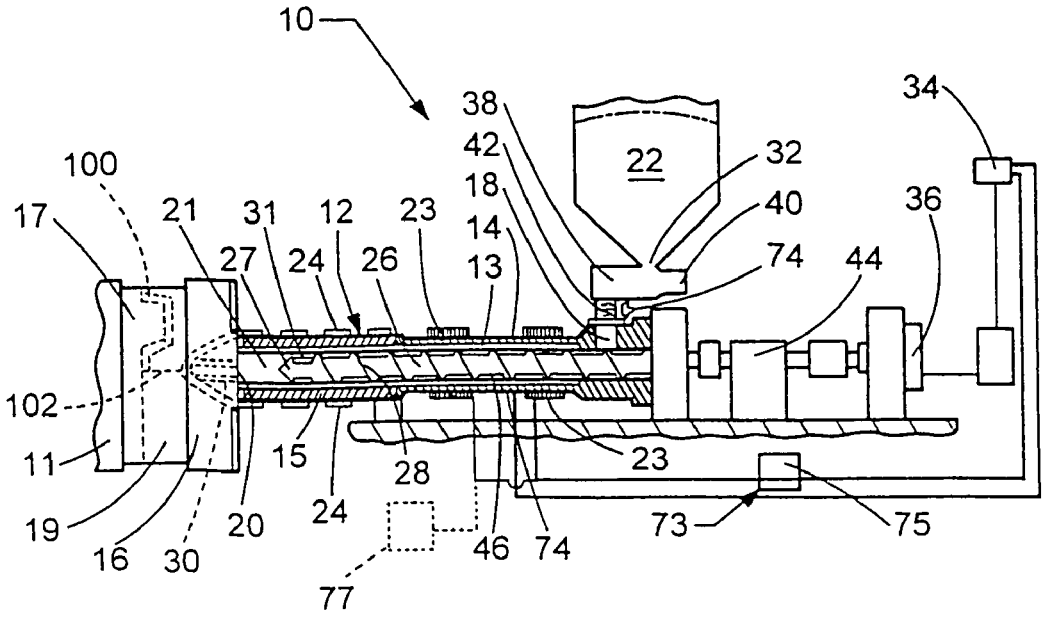
FIG. 1 is a diagrammatic illustration of a semisolid metal injection molding machine according to the present invention.

Referring now to the drawings, a machine or apparatus for processing a metal material into a thixotropic state or molten state and molding the material to form molded, die cast, or articles for forging according to the present invention is generally illustrated in FIG. 1 and designated at 10. Unlike typical die casting or forging machines, the present invention is adapted to use a solid state feedstock of a metal or metal alloy (hereinafter just "alloy"). This eliminates the use of a melting furnace, in die casting processes, along with the environmental and safety limitations associated therewith. The present invention is illustrated as accepting feedstock in a chipped or pelletized form. These feedstock forms are preferred, but other forms may be used. The apparatus 10 transforms the solid state feedstock into a semisolid, thixotropic slurry or liquid which is then formed into an article of manufacture by either injection molding or die casting.

The apparatus 10, which is generally shown in FIG. 1, includes a barrel 12 coupled to mold halves 17, 19. As more fully discussed below, the barrel 12 includes a liner 13, a cold section or inlet section 14, and a hot section or shot section 15 and an outlet nozzle 30. An inlet 18 located in the cold section 14 and an outlet 20 located in the hot section 15. The inlet 18 is adapted to receive the alloy feedstock (shown in phantom) in a solid particulate, pelletized or chip form from a feed hopper 22. Preferably the feedstock is provided in the chip form and is of a size within the range of 5–18 mesh.

In the illustrated example, the inlet section 14 occupies approximately one half of the overall length of the barrel 12 and is constructed as a separate section. It should be noted that the inlet and shot sections 14 and 15 could be unitarily constructed and that the inlet section 14 can occupy more or less than one half of the overall barrel length. These are factors design criteria which will depend on the specifics of individual machines.

One group of alloys which are suitable for use in the apparatus 10 of the present invention includes magnesium alloys. However, the present invention should not be interpreted as being so limited. It is believed that any metal or metal alloy which is capable of being processed into a thixotropic state will find utility with the present invention, in particular Al, Zn, Ti and Cu based alloys.

At the bottom of the feed hopper 22, the feedstock is discharged, either gravitationally or by other means, through an outlet 32 into a volumetric feeder 38 or other feeder. A feed auger (not shown) is located within the feeder 38 and is rotationally driven by a suitable drive mechanism 40, such as an electric motor. Rotation of the auger within the feeder 38 advances the feedstock at a predetermined rate for delivery into the barrel 12 through a transfer conduit or feed throat 42 and the inlet 18.

Once received in the barrel 12, induction coils 23 heat the feedstock in the initial zones, zones 1 and 2, of the barrel 12 to a predetermined temperature (based on the material being processed) so that the material is brought into its two-phase region. By way of examples, for AZ91D, the temperature in zone 1 is typically in the range of 900–1000° F. and in zone 2 is typically in the range of 1080–1130° F. For AM60, the temperature in zone 1 is in the range of 950–1050° F. and in zone 2 is in the range of 1100–1160° F. In this two-phase region with the temperature of the feedstock in the barrel 12 between the solidus and liquidus temperatures of the alloy, the feedstock partially melts and is in an equilibrium state having both solid and liquid phases. Alternatively, and depending on the desired characteristics of the resultant article of manufacture, the material may be heated into an all liquid state.

Temperature control is provided with the induction coils 23 in order to achieve this intended purpose. As illustrated, the induction coils 23 are representatively shown in FIG. 1 and consist of induction low frequency heaters, presently 60 Hz. The induction coils 23 are located along the two initial zones of the barrel 12, at specific positions and spacings to achieve the desired heating profile of the barrel, feedstock and screw.

As mentioned above, the induction coils 23 generate an alternating flux field that induces a current in the work piece that is equal and opposite to the inducing current. The current in the work piece generates joule ($I^2R$) heating and the depth of heating is governed by the properties of the work piece according to the following equation:

$$\text{delta}=1.983*(\text{rho}/\text{mu}/\text{frequency})^{1/2}$$

Delta is defined as the depth (in inches) at which the current has decreased to I/e of the current at the surface and therefore the volumetric power generation is $I/e^2$ of the surface value. Further, delta is the depth at which the product $I^2$ of the fully integrated current generated in the work and R the resistance of the work piece will equal the total integrated power generation. "[R]ho" is the material resistivity in micro-ohm cm. "[M]u" is the relative permeability of the material (non magnetic materials having mu=1). Finally, frequency is in Hertz.

By the proper selection of the materials, the physical dimensions and the frequency the equipment can be designed to minimize the through wall temperature gradient, and therefore, minimize the thermal stresses. Additionally, the heat generated can be optimized in the internally located member or screw. For example, the exterior wall of the barrel, may be thinner, of a material with high electrical resistivity, and non-magnetic to allow the magnetic field to pass through to the internal screw that may be manufactured of a material with magnetic properties. The barrel may be constructed of more than one material to provide the mechanical strength desired in addition to controlling the wall temperature distribution, power distribution between the wall and the screw or other results as may be desired for particular materials and machine design. In fact, the coil could be encased within the barrel wall to further reduce any temperature differential to the inner diameter if desired. Although the initial or proving equipment was optimized at 60 Hz, various frequency can be applied based upon the desired equipment configuration and desired thermal profiles. Further, the frequency can be varied during the metal processing or the heat cycle to distribute the heat as desired either preferentially to the screw or preferentially to the barrel, for example, between the preheat portion of the cycle and the production portion of the cycle, or varied depending upon the power distribution desired for various production rates or various production material melting temperature profile requirements. Also the frequency may vary between the first coil and subsequent coils to accomplish a desired heating/melting/temperature differential result. Generally, smaller equipment would have higher frequencies and larger equipment lower frequencies. For example, while a barrel with a 2 inch thick wall may provide optimum performance with a frequency of 60 Hz, a 3 inch thick wall may provide optimum performance with a frequency of 26 Hz. Additional considerations may be optimization of the barrel, screw, heated length and frequency to optimize the electromagnetic stirring within the semi-solid or molten material for improved material properties.

The power system 73 for the coils, in the case of 50 or 60 Hz, may be single phase directly from the line with suitable power control, power factor correction and voltage matching components. The power source may also be an inverter that would present a balance three (or multiple) phase high power factor load to the line and produce the desired single phase secondary power at the desired frequency required for the particular application. There may be one or several inverters from one DC source. The power level is generally controlled by thermocouple feedback 74 but may be controlled from any desired feedback parameter such as from a suitable smart sensor control technique.

Figure 10:
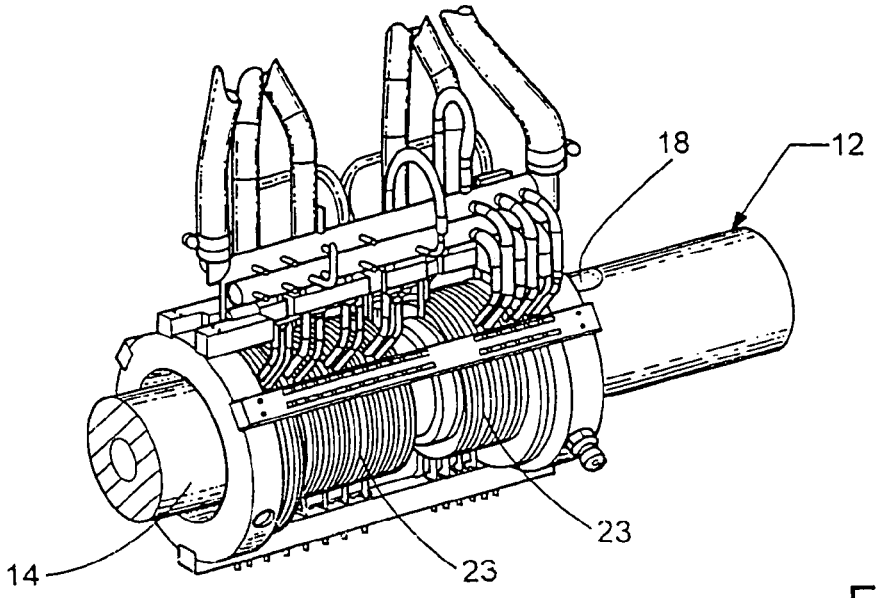
FIG. 10 is an illustration of two induction coil heaters mounted to a barrel adjacent to the barrel inlet.

Seen in FIG. 10 is one representative example of the location and placement of the inductive coils 23. A 245 ton JSW machine, as outlined above, with a one-piece barrel (6.7 inch outer diameter) was provided with two inductive coils on the cold section of the barrel. The first induction coil, the coil closest to the feed throat 42, includes eleven turns with a gap spacing of about 0.2 inches relative to one another. Generally, overlying the above first four turns are three additional larger diameter (approximately 10.8 inch O.D.) turns of equidistant spacing (gap spacing of about 0.3 inches). Total length of the first induction coil is about 5.5 inches and its location on the barrel is about 6–7 inches from the centerline of the feedthroat 42. Additionally, a 2 inch wide plastic collar is located between the feed throat and the first induction coil. Power at a steady state to the first induction coil is generally in the range of 15–20 kW and the set temperature is generally in the range of 950–970° F.

The second induction coil is approximately 10 inches in length and spaced about 3.5 inches from the first induction coil. A first set of coils includes a total of sixteen turns spaced relative to one another with a gap spacing of about 0.4 inches. Overlying the more closely spaced turns are four additional, larger diameter (approximately 10.8 inch O.D.) turns. These turns are equidistantly spaced with a gap spacing of about 0.3 inches. Downstream of the second induction coil is located another, 2 inch wide plastic collar. Power at steady state to the second induction coil is approximately 20–28 kW and the set temperature is 1130° F.

In the above system, two power supplies 75 and 77 (designated in FIG. 1) were utilized. The system, however, could be energized with one or more power supplies, depending on the equipment design, the material being processed, etc.

Utilizing these induction coils 23 generally seen in FIG. 10, above with AZ91D, a cycle time of 20 seconds and less has been achievable. Equipped with band heaters, the same 245 ton machine operates at a cycle time of 32 to 47 seconds. The present invention accordingly results in at least a 37% reduction in cycle time for molding a four bar tensile molding as per ASTM B 557-94.

Figure 2B:
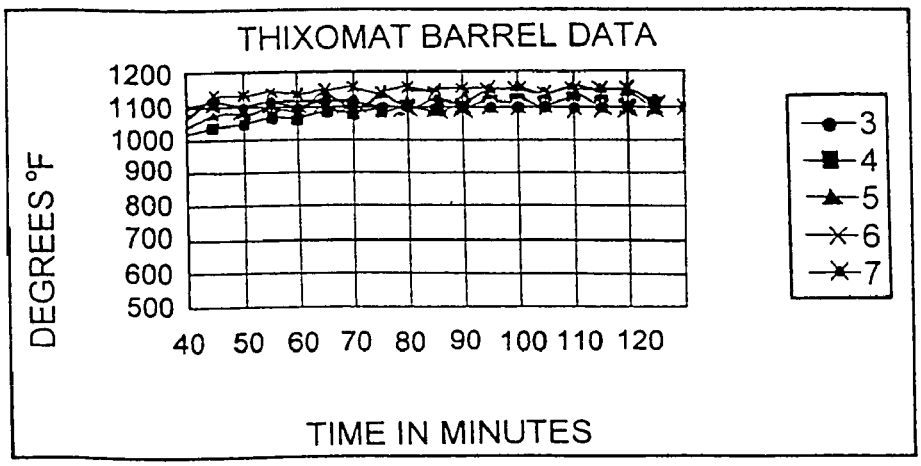
FIG. 2B is a plot of the data seen in FIG. 2A.
Figure 2A:
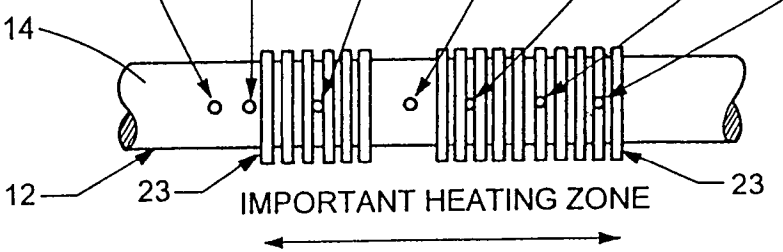
FIG. 2A is a temperature profile table and graph for the initial two zones of a barrel and screw (no molding alloy present) heated according to the principles of the present invention.

Referring now to the chart of FIG. 2A, an initial test inductor coil 23 represented in zone 1 contained six turns while a second test inductor coil 23 represented in zone 2 contains ten turns. Through the use of these test inductor coils 23, in less than 45 minutes it is seen that the barrel 12 is heated for AZ91D, to its desired temperature of about 950° F. (measurement taken at point 2 in zone 1) and about 1000° F. (measurement taken at point 5 in zone 2). This temperature verses time data is graphically illustrated in FIG. 2B for points 3 through 7, those points or locations for which target temperatures are established.

The remaining length of the barrel 12 may be heated with conventional resistance or ceramic band heaters 24 or alternatively with additional induction coils 23. Temperature control means in the form of induction coils 23, ceramic band or other heaters 24 may also be placed about the nozzle 30 to aid in controlling its temperature and readily permit the formation of a critically sized solid plug of the alloy in the nozzle 30. The plug prevents the drooling of the semi-solid alloy from the barrel 12 or the back flowing of air (oxygen) or other contaminant into the protective internal atmosphere (typically argon) of the apparatus 10. Such a plug also facilitates evacuation of the mold 16 when desired, e.g. for vacuum assisted molding.

The apparatus may also include a stationary platen 16 and moveable platen 11, each having respectively attached thereto a stationary mold half 19 and a moveable mold half 17. Mold halves include interior surfaces which combine to define a mold cavity 100 in the shape of the article being molded. Connecting the mold cavity to the nozzle 30 are a runner (which may be hot runners), gate and sprue, generally designated at 102. Operation of the mold halves 17, 19 is otherwise conventional and therefore is not being described in greater detail herein.

In the present embodiment, a reciprocating screw 26 is positioned in the barrel 12 and is rotated by an appropriate drive mechanism 44, such as an electric motor, so that vanes 28 on the screw 26 subject the alloy to shearing forces and move the alloy through the barrel 12 toward the outlet 20. The shearing action conditions the alloy into a thixotropic slurry consisting of spherulites of rounded degenerate dendritic structures surrounded by a liquid phase. Alternatively, the alloy can be processed into an all liquid phase.

During operation of the apparatus 10, the induction coils 23 are turned on to thoroughly heat the barrel 12 and the screw 26 to the proper temperature or temperature profile along its length. Additionally, the band or resistance heaters 24 are also turned on. Generally, for forming thin section parts, a high temperature profile is desired, for forming mixed thin and thick section parts a medium temperature profile is desired and for forming thick section parts a low temperature profile is desired. Once thoroughly heated, the system controller 34 then actuates the drive mechanism 40 of the feeder 38 causing the auger within the feeder 38 to rotate. This auger conveys the feedstock from the feed hopper 22 to the feed throat 42 and into the barrel 12 through its inlet 18. If desired, preheating of the feedstock is performed in either the feed hopper 22, feeder 38 or feed throat 42.

In the barrel 12, the feedstock is engaged by the rotating screw 26 which is being rotated by the drive mechanism 44 that was actuated by the controller 34. Within the bore 46 of the barrel 12, the feedstock is conveyed and subjected to shearing by the vanes 28 on the screw 26. As the feedstock passes through the initial zones of barrel 12, the feedstock is directly heated by the induction coils 23 and indirectly heated by the barrel 12 and screw 26 and further heated by the shearing action to the desired temperature between its solidus and liquidus temperatures. In this temperature range, the solid state feedstock is transformed into a semisolid state comprised of the liquid phase of some of its constituents in which is disposed a solid phase of the remainder of its constituents. The rotation of the screw 26 and vanes 28 continues to induce shear into the semisolid alloy, at a rate sufficient to prevent dendritic growth with respect to the solid particles thereby creating a thixotropic slurry.

The slurry is advanced through the barrel 12 until an appropriate amount of the slurry has collected in the fore section 21 (accumulation region) of the barrel 12, beyond the tip 27 of the screw 26. The screw rotation is interrupted by the controller 34 which then signals an actuator 36 to advance the screw 26. A non-return valve 31 prevents the material from flowing rearward toward the inlet 18 during advancement of the screw 26. If desired, the shot charge in the fore section 21 of the barrel 12 may be compacted at a relatively slow speed to squeeze or force excess gas, including the protective gas of the atmosphere, out of the charge of slurry. Thereafter, the velocity of the screw 26 is rapidly increased raising the pressure to a level sufficient to blow or force the plug from the nozzle 30 into a sprue cavity designed to catch it and force the alloy through a nozzle 30 associated with the outlet 20 and into the mold 16. As the instantaneous pressure drops, the velocity increases to a programmed level, typically in the range of 40 to 120 inches/second in the case of magnesium alloys. When the screw 26 reaches the position corresponding to a full mold cavity, the pressure again begins to rise at which time the controller 34 ceases advancement of the screw 26 and begins retraction at which time it resumes rotation and processing of the next charge for molding. The controller 34 permits a wide choice of velocity profiles in which the pressure/velocity relationship can be varied by position during the shot cycle (which may be as short as 25 milliseconds or as long as 200 milliseconds).

Once the screw 26 stops advancing and the mold is filled, a portion of the material located within the nozzle 30 at its tip solidifies as a solid plug. The plug seals the interior of barrel 12 and allows the mold 16 to be opened for removal of the molded article.

During the molding of the next article, advancement of the screw 26 will cause the plug to be forced out of the nozzle 30 and into the sprue cavity which is designed to catch and receive the plug without interfering with the flowing of the slurry through the gate and runner system 102 into the mold cavity 100. After molding, the plug is retained with the solidified material of the gate and runner system 102, trimmed from the article during a subsequent step and returned to recycling.

Figure 4:
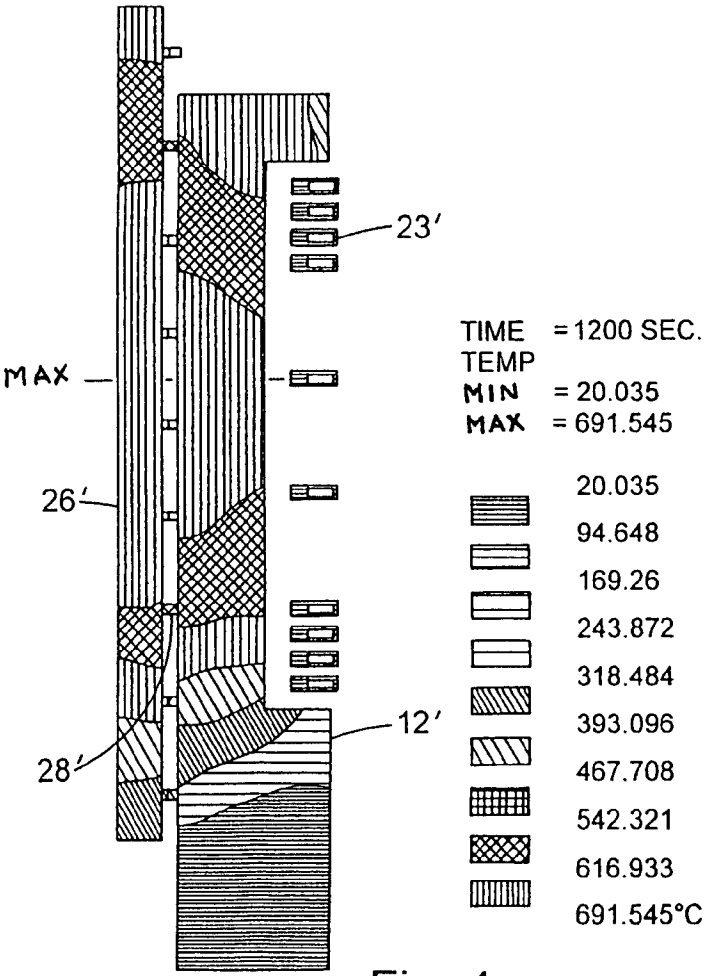
FIGS. 3, 4 and 5 are thermal contour models for the initial two zones of a two piece barrel, according to U.S. Pat. No. 6,059,012 (hereby incorporated by reference), (of alloy 718) and screw (of steel 2888) during preheating, at full preheat and during production, respectively.
Figure 3:
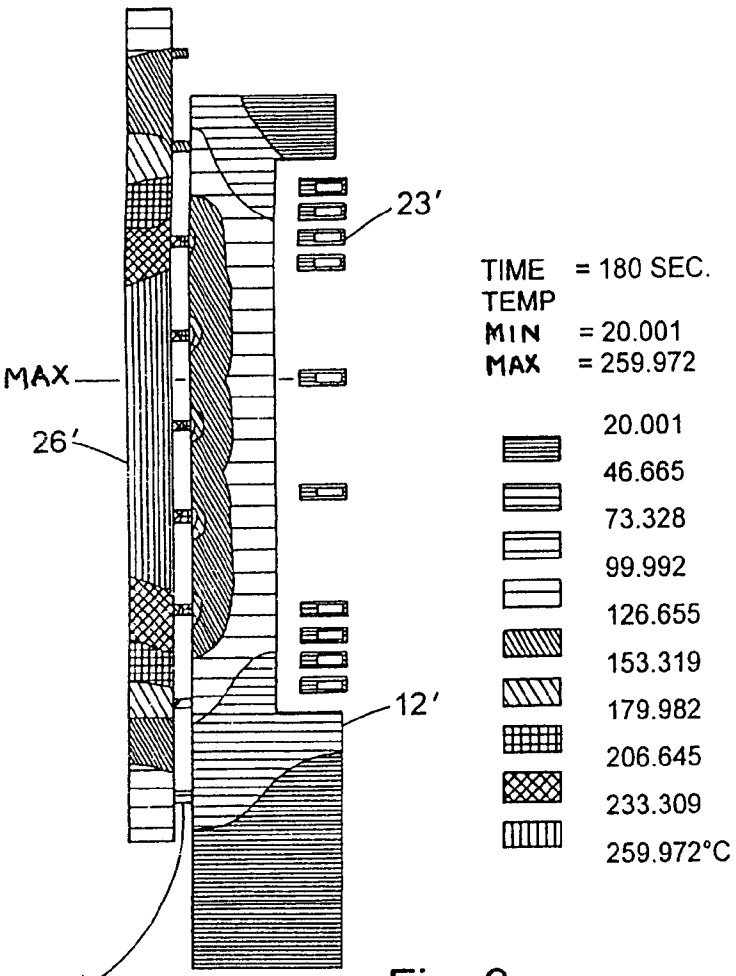
Figure 5:
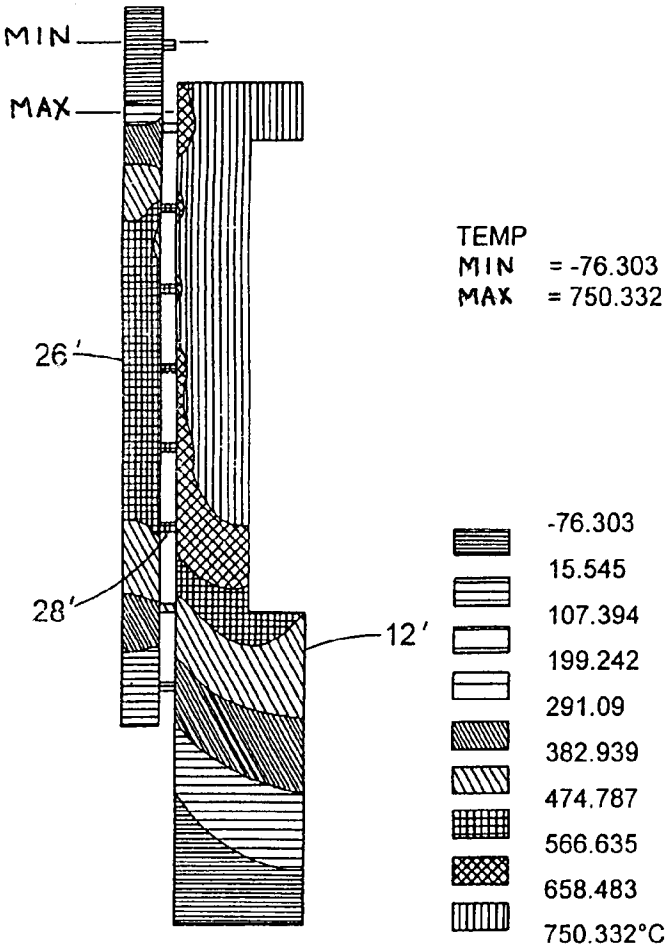

Seen in FIGS. 3, 4 and 5 are thermal contour models for the first part of a two-piece barrel (alloy 718). Such a two-piece barrel and screw construction is disclosed in U.S. Pat. No. 6,059,012 which is herein incorporated by reference. This first part or cold section of the barrel 12' includes the first two heating zones (zones 1 and 2) of the barrel 12'. During initial preheating (FIG. 3), through use of the inductive coils 23' it is possible for the screw 26' to be heated before the barrel and for the screw 26' at least through the vanes 28', to heat the barrel 12' allowing the barrel 12' to be heated from the inside out. Initially, heat is seen as being concentrated at the center portion of the screw 26' within this section of the barrel 12' and as being conducted through the vanes 28' to the center portion of this part of the barrel 12'.

At full preheat, FIG. 4, heat is concentrated, or spread over a greater axial length, internally of the barrel 12'. This provides a greater amount of the heat for actual use in heating the feedstock instead of heating the barrel 12' itself. Additionally, there is no temperature gradient through the barrel.

During production, the introduced feedstock extracts a significant amount of heat from the screw 26' since the feedstock circumferentially surrounds the screw 26'. The barrel 12' temperature remains steady without the large thermal gradients through sections of the barrel 12' thickness as previously occurred. With the present construction, temperature gradients of less than 100° C. are maintained through a wall section thickness of the barrel 12'. Additionally, as the feedstock moves longitudinally within the barrel 12' and the barrel 12' becomes heated, the thermal profile of the barrel 12' exhibits a greater temperature progressing toward the hot end or section of the barrel 12'. A significant amount of heat remains available in the barrel 12'.

Figure 6:
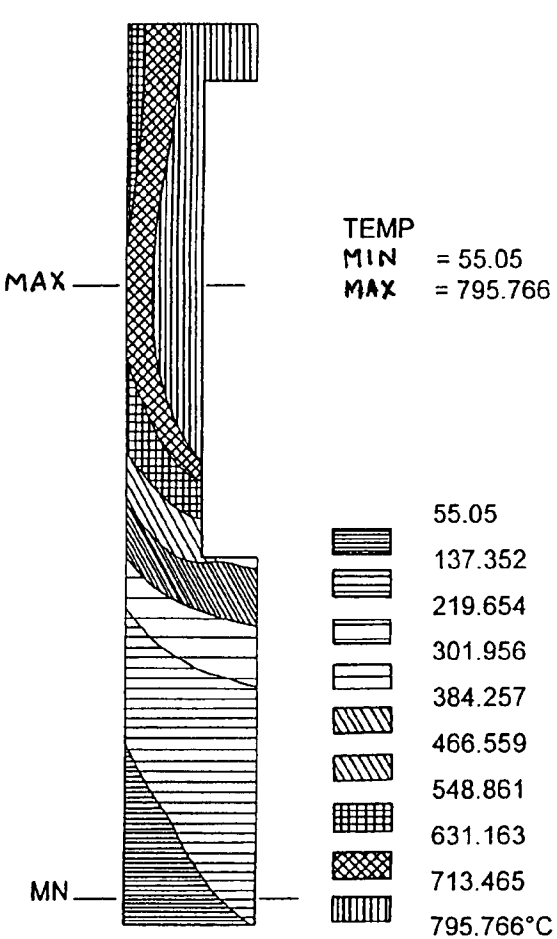
FIG. 6 is a thermal contour model for the initial two zones of a two piece barrel (of steel 2888), according to U.S. Pat. No. 6,059,012 (hereby incorporated by reference), heated in accordance with the principles of the present invention.

If the material of the barrel 12' is changed from the superalloy to steel 2888, it is noted that a increased temperature gradient develops in the barrel 12' during production operation. This is presented in FIG. 6.

The chart of FIG. 7 shows a comparative of the benefits of low frequency inductive heating over ceramic band heaters with barrel and liner stresses, including longitudinal, radial, hoop and Von Mises stresses, during preheating. Similarly, the chart of FIG. 8 shows a comparison of the benefits of low frequency inductive heating on a particle size.

Figure 9:
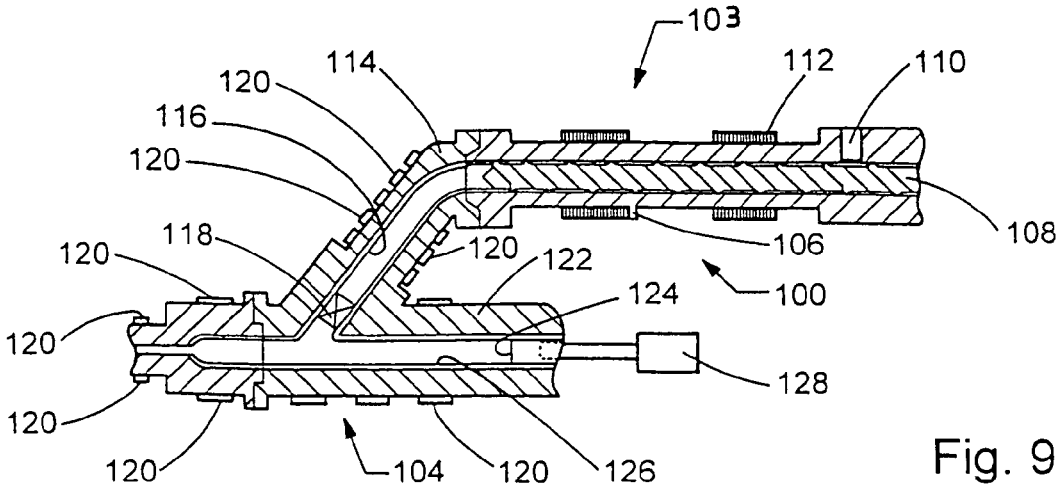
FIG. 9 is a diagrammatic illustration of a second embodiment of the present invention.

In another embodiment seen in FIG. 9, the apparatus 100 is a two stage machine having a first stage 103, where the alloy is initially processed and a second stage 104, where the processed alloy is caused to be forced into a mold. Since various components of the apparatus 100 of the second embodiment are the same as those in the prior embodiment, only the first and second stages 103, 104 need be and are illustrated in FIG. 9.

The first stage 103 generally include the barrel 106 within which is located a screw 108 is rotated by an appropriate drive mechanism so as to impart shear to the feedstock received into the barrel 106 through the inlet 110. Located along the length of the barrel 106 are a series of inductive coils 112. As discussed in connection with the prior embodiment, the inductive coils 112 induce heating of the barrel 106, screw 108 and the feedstock. The action of the shearing and the imparting of heat to the feedstock results in the feedstock being processed into a molten or semisolid state, or alternatively, a full liquid state. Continued rotation of the screw 108, longitudinally moves the material through the barrel 106 away from the inlet 110.

The processed material is transferred from the first stage 103 through a transfer coupling 114 to the second stage 104. The transfer coupling 114 includes a passageway defined therethrough which may be lined by a liner 116 and which terminates at a valve 118. Additionally, resistance or ceramic band heaters 120 are placed about the length of the transfer coupling 114.

While illustrated in FIG. 9 as having a parallel barrel 106 and shot sleeve 122 arrangement, it is noted that orientation of the barrel 106 may be non-parallel to the shot sleeve 122. Additionally, the feedstock may be gravitationally fed through the barrel 106 and may be sheared by mechanisms other than a screw 108, such as by paddles, a tortuous path or a non-contact electro-magnetic method or other method.

The second stage 104 includes a second barrel or shot sleeve 122 (which may also be lined) within which is disposed a piston or plunger 124. This second stage 104 may further, but not necessarily, include additional heaters 120 to provide heat input so as to maintain the processed material at the appropriate temperature once it has been received into the passageway 126 of the shot sleeve 122. Upon the appropriate amount of material being received into the passageway 126 of the second stage 104, an actuation mechanism 128 coupled to the plunger 124 is advanced. Upon advancement of the plunger 124, the material is forced out of the shot sleeve 122, the valve 118 preventing back flow up through the transfer coupling 114, through a nozzle and into the mold assembly (not shown).

In substantially all other respects the apparatus 100 of the second embodiment operates in the same manner and fashion as the apparatus 10 of the first embodiment. For this reason, further discussion regarding the operation of this second embodiment need not be presented herein.

While described with particular reference to a reciprocating screw style of semisolid metal injection molding machine, it is readily understood that the present invention will have application to other styles of metal molding machines, including two-stage (barrel and shot sleeve) semisolid metal injection molding machines and even to machines for molding or casting materials in non-thixotropic states.

The invention claimed is:

1. A method of heating a metal material for subsequent molding comprising the steps of:

introducing the metal material into a vessel having a member located within the vessel;

locating the metal material about the member;

heating the metal material with low frequency induction heating at an operating frequency of less than 1000 Hz to achieve a temperature for molding;

maintaining a temperature gradient of less than 100° C. through a wall thickness section of the vessel; and ejecting the metal material from the vessel.

2. The method of claim 1 wherein said heating step further comprises the step of at least partially directly heating the metal material.

3. The method of claim 1 wherein said heating step includes the step of low frequency inductive heating of the vessel itself.

4. The method of claim 1 wherein said heating step includes the step of low frequency inductive heating of the member.

5. The method of claim 1 wherein said heating step includes the step of at least partially indirectly heating of the metal material.

6. The method of claim 1 wherein said heating step includes the step of low frequency inductive heating of the vessel, the member and the metal material.

7. The method of claim 1 further comprises the step of heating the metal material to a temperature above its solidus temperature, but not exceeding its liquidus temperature.

8. The method of claim 1 further comprising the step of stirring the metal material to decrease particle size and increase roundness of said solid phase in the metal material.

9. The method of claim 1 further comprising the step of heating the metal material to a temperature above its liquidus temperature.

10. The method of claim 1 further comprising the step of preheating the member and vessel.

11. The method of claim 10 wherein said preheating step includes the step of inductively heating the member.

12. The method of claim 1 wherein said step of ejecting the metal material includes the step of axially retracting the member within the vessel.

13. The method of claim 1 wherein said maintaining step maintains a temperature gradient of less than 50° C. through a wall thickness section of the vessel.

14. The method of claim 1 wherein said maintaining step maintains a temperature gradient of about 25° C. through a wall thickness section of the vessel.

15. The method of claim 1 wherein the heating step includes the step of extracting heat from the member to heat the metal material.

16. A method of heating a metal material for subsequent molding comprising the steps of:

introducing the metal material into a vessel having a member located within the vessel;

locating the metal material about the member;

heating the metal material through low frequency induction heating at an operating frequency of less than 1000 Hz to achieve a temperature for molding;

maintaining a temperature gradient of less than 100° C. through the thickness of a wall section of the vessel; and ejecting the metal material from the vessel.

17. The method of claim 16 wherein said ejecting step ejects the material out of the vessel under pressure.

18. The method of claim 16 wherein said ejecting step includes the step of retracting the member and advancing the member to eject the material.

19. The method of claim 16 further comprising the step of heating the material to a temperature between its solidus and liquidus temperatures.

20. The method of claim 16 further comprising the step of stirring the metal material to decrease particle size and increase roundness of a solid phase in the metal material.

* * * * *

UNITED STATES PATENT AND TRADEMARK OFFICE

CERTIFICATE OF CORRECTION

PATENT NO. : 7,028,746 B2
APPLICATION NO. : 10/685951
DATED : April 18, 2006
INVENTOR(S) : Ron Akers et al.

It is certified that error appears in the above-identified patent and that said Letters Patent is hereby corrected as shown below:

Column 13, in claim 1, line 9, delete "100° C." and substitute --100° C-- in its place.

Column 14, in claim 13, line 2, delete "50° C." and substitute --50° C-- in its place.

Column 14, in claim 14, line 2, delete "25° C." and substitute --25° C-- in its place.

Column 14, in claim 16, line 9, delete "100° C." and substitute --100° C-- in its place.

Signed and Sealed this

Nineteenth Day of December, 2006

JON W. DUDAS
*Director of the United States Patent and Trademark Office*